US007121105B1

(12) United States Patent
Rais

(10) Patent No.: US 7,121,105 B1
(45) Date of Patent: Oct. 17, 2006

(54) WINDOW-MOUNTED SPLIT AIR CONDITIONING APPARATUS AND METHOD OF INSTALLATION

(76) Inventor: Elliot Rais, 60 Sutton Pl. South, New York, NY (US) 10022

( * ) Notice: Subject to any disclaimer, the term of this patent is extended or adjusted under 35 U.S.C. 154(b) by 0 days.

(21) Appl. No.: 11/260,717

(22) Filed: Oct. 27, 2005

Related U.S. Application Data

(60) Provisional application No. 60/707,973, filed on Aug. 15, 2005.

(51) Int. Cl.
*F25D 23/12* (2006.01)

(52) U.S. Cl. ..... 62/262

(58) Field of Classification Search ..... 62/262, 62/236, 297, 298, 302; 454/201, 203, 204; 248/544, 657
See application file for complete search history.

(56) References Cited

U.S. PATENT DOCUMENTS

| | | | | |
|---|---|---|---|---|
| D112,881 | S | 1/1939 | Kruck | |
| 2,268,451 | A | 12/1941 | Hull | |
| 2,320,436 | A | 6/1943 | Hull | |
| 2,760,354 | A | 8/1956 | Brady | |
| D179,726 | S | 2/1957 | Harpman | |
| 3,176,474 | A | 4/1965 | Abbott | |
| 3,296,820 | A | 1/1967 | Bauman | |
| 3,392,546 | A | 7/1968 | Reed | |
| 3,416,329 | A | 12/1968 | Thomas | |
| 3,448,590 | A | 6/1969 | Eberhart | |
| 3,665,726 | A | 5/1972 | Preotle | |
| 4,057,892 | A * | 11/1977 | White | 29/525.11 |
| 4,607,499 | A * | 8/1986 | Bolton et al. | 62/262 |
| 4,607,500 | A * | 8/1986 | Bolton et al. | 62/262 |
| 5,027,614 | A * | 7/1991 | Mori et al. | 62/262 |
| 5,167,131 | A * | 12/1992 | Karkhanis | 62/262 |
| 5,253,485 | A | 10/1993 | Kennedy | |
| D341,880 | S | 11/1993 | Ames | |
| 5,272,886 | A * | 12/1993 | Ukai et al. | 62/280 |
| 5,295,903 | A * | 3/1994 | Bolton et al. | 454/203 |
| 5,317,795 | A * | 6/1994 | Bolton et al. | 29/434 |
| 5,582,025 | A * | 12/1996 | Dubin et al. | 62/262 |
| 5,687,581 | A * | 11/1997 | Price | 62/263 |
| 6,145,334 | A | 11/2000 | Mochizuki | |
| 6,216,482 | B1 | 4/2001 | Xiao | |
| 6,389,834 | B1 * | 5/2002 | LeClear et al. | 62/280 |
| 6,460,363 | B1 * | 10/2002 | Moretti et al. | 62/262 |
| 6,568,201 | B1 * | 5/2003 | Cur et al. | 62/262 |

FOREIGN PATENT DOCUMENTS

| | | | |
|---|---|---|---|
| JP | 8-178353 | A * | 7/1996 |

* cited by examiner

*Primary Examiner*—Mohammad M. Ali
(74) *Attorney, Agent, or Firm*—Kirschstein et al.

(57) ABSTRACT

A split air conditioning apparatus is readily installed at a window opening by accessible actuators. The apparatus is affirmatively prevented from falling from the window opening, both during and after installation.

20 Claims, 5 Drawing Sheets

FIG.1
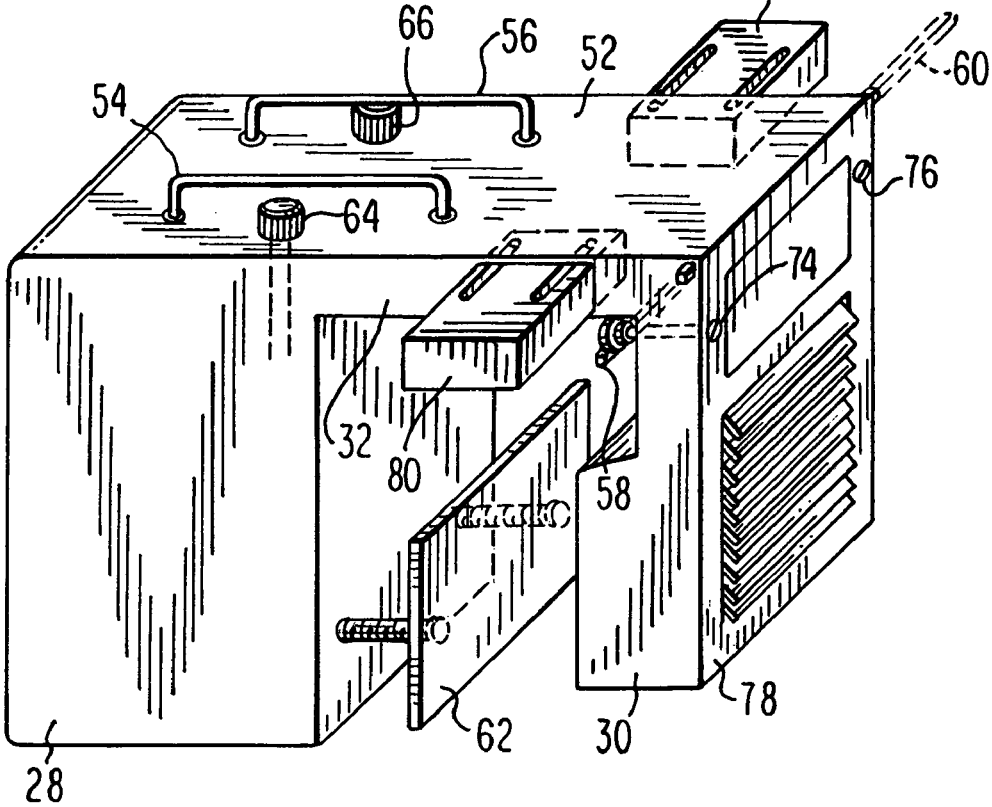
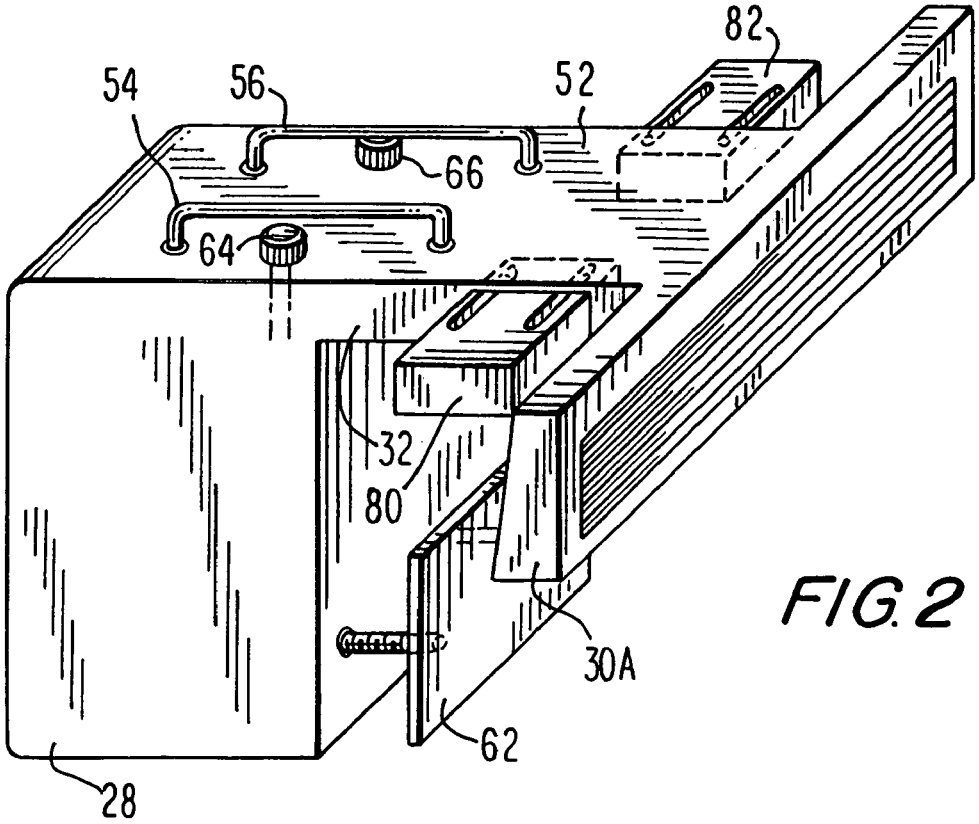
FIG.2

FIG. 3
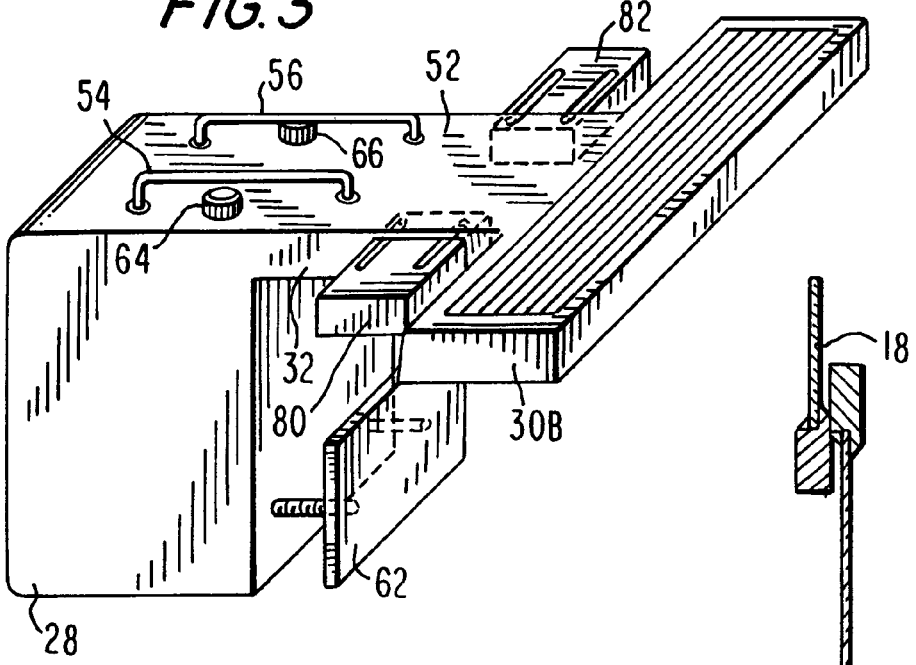
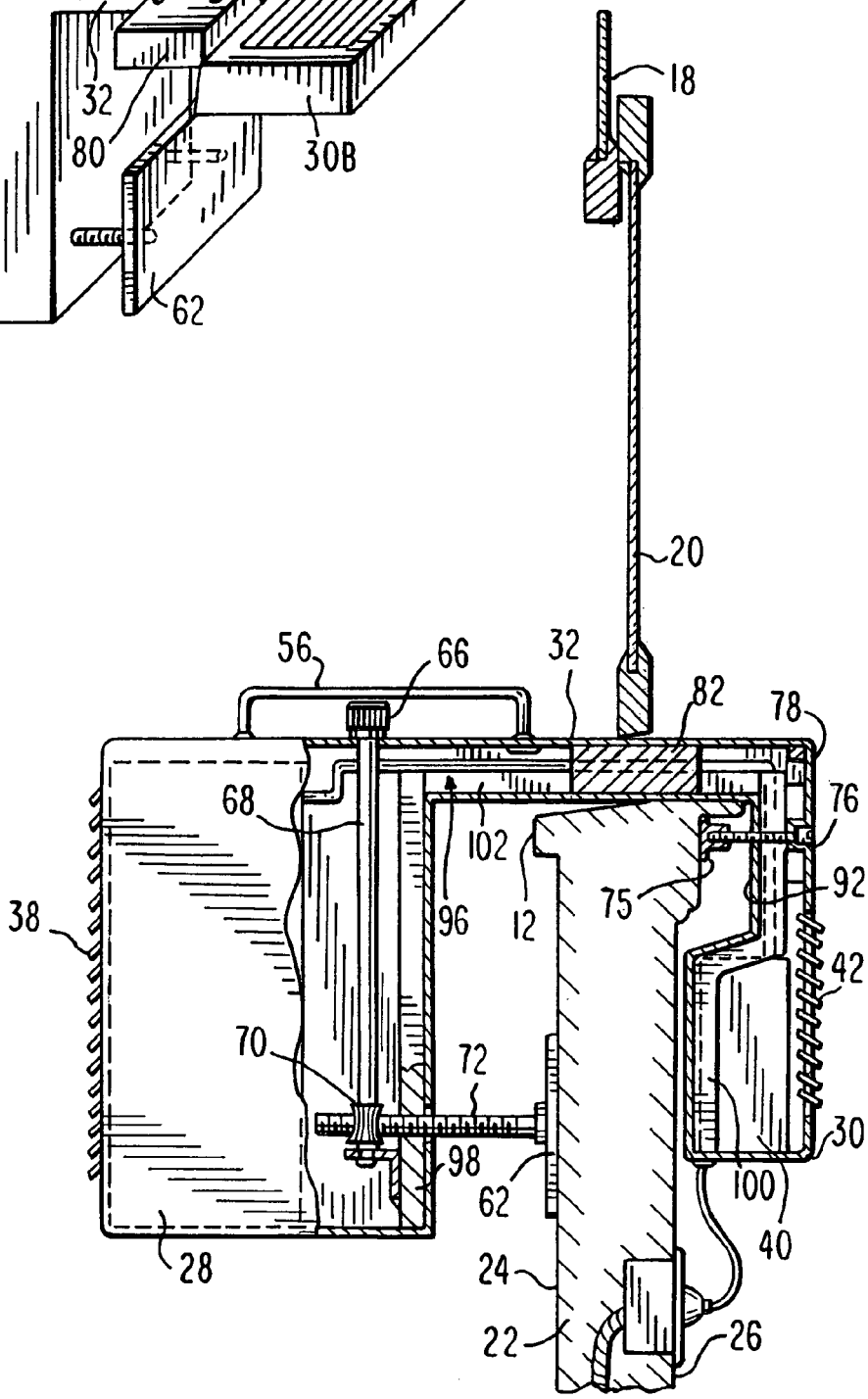
FIG. 5

FIG.4
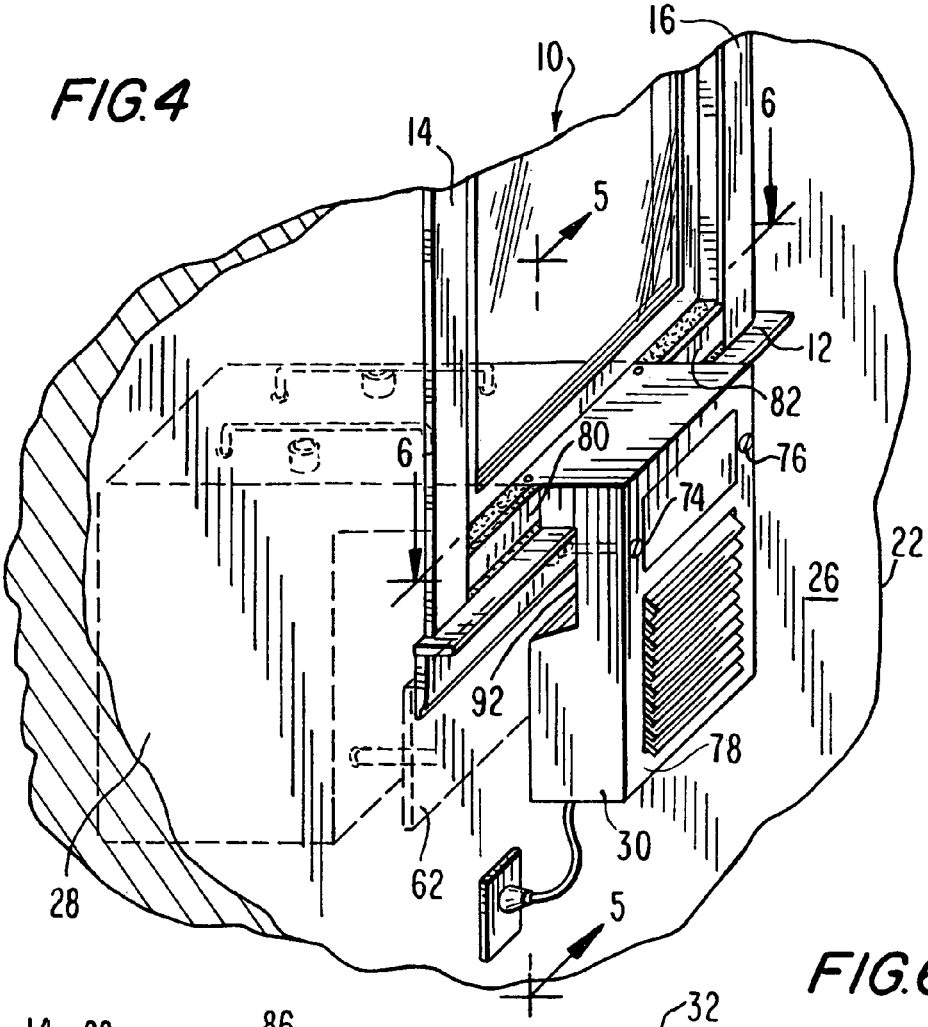
FIG.6
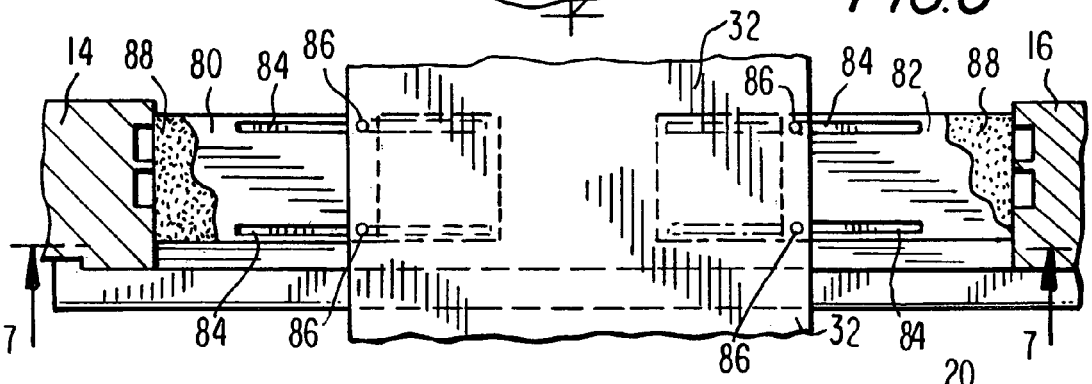
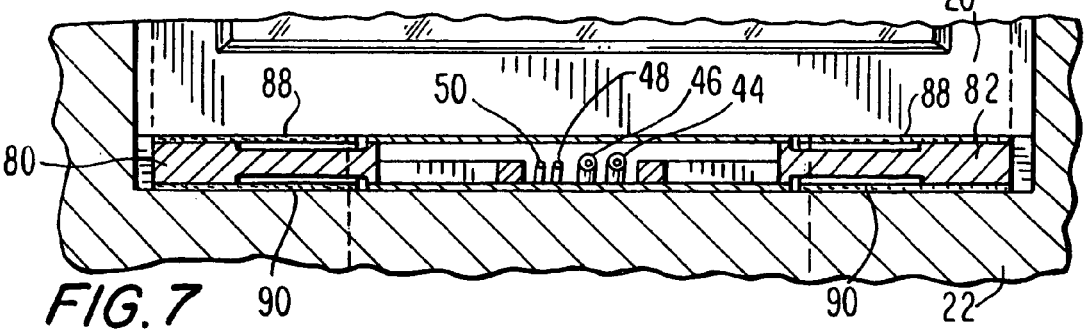
FIG.7

FIG. 10
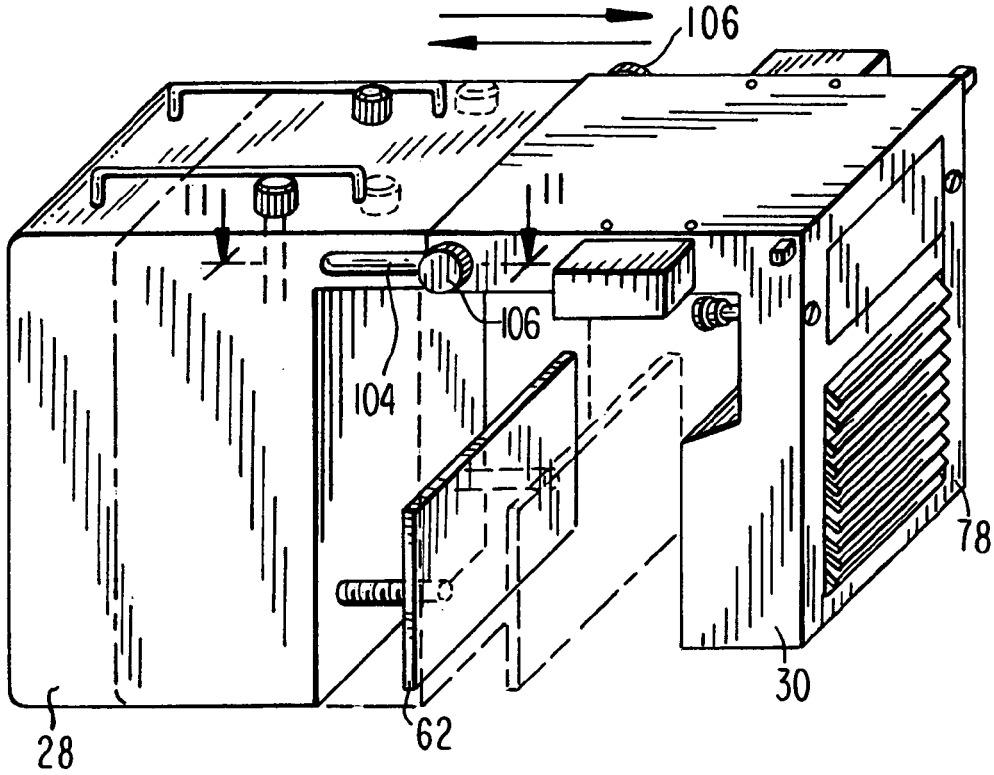
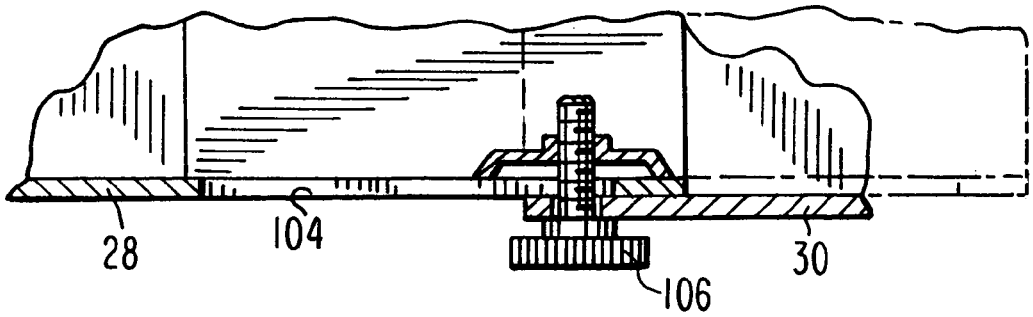
FIG. 11

WINDOW-MOUNTED SPLIT AIR CONDITIONING APPARATUS AND METHOD OF INSTALLATION

CROSS REFERENCE TO RELATED APPLICATIONS

This application claims the benefit of the filing date of U.S. Provisional Patent Application Ser. No. 60/707,973, filed Aug. 15, 2005.

BACKGROUND OF THE INVENTION

1. Field of the Invention

The present invention generally relates to an air conditioning apparatus and its installation in a window opening and, more particularly, to a low-profile air conditioning apparatus in which indoor and outdoor sections are located at opposite sides of the window opening and are connected by a connector section resting on a window sill.

2. Description of the Related Art

A conventional room air conditioner for installation in a window opening typically comprises a single box-like housing comprising all the components of a refrigeration system. However, such air conditioners occupy valuable window space, are noisy, and are difficult to install due to their bulk and weight from the inside of a room.

To avoid such drawbacks, the art has proposed so-called "saddle" or "split" air conditioners in which an outdoor section houses the refrigeration components for dissipating heat, for example, the condenser, an indoor section houses the refrigeration components for absorbing heat, for example, the evaporator, and a connector section rests on a window sill and maintains the indoor and outdoor sections apart at opposite sides of the window opening. The connector section has a minimal height above the sill, thereby increasing the window space and allowing more light to enter the room, as well as enabling the room occupants to have an increased field of view. The placement of at least some of the components outside the window opening lessens the noise within the room.

Saddle-type air conditioners are disclosed in U.S. Pat. No. 2,268,451; U.S. Pat. No. 2,320,436; U.S. Pat. No. 3,176,474; U.S. Pat. No. 3,296,820; U.S. Pat. No. 3,392,546; U.S. Pat. No. 3,448,590; U.S. Pat. No. 5,167,131; U.S. Pat. No. 5,582,025; and No. D-341,880. Related air conditioners are disclosed in U.S. Pat. No. 2,760,354; U.S. Pat. No. 3,416,329; U.S. Pat. No. 3,665,726; U.S. Pat. No. 5,027,614; U.S. Pat. No. 5,253,485; U.S. Pat. No. 6,216,482; U.S. Pat. No. 6,145,334; No. D-112,881; and No. D-179,726.

Experience has shown, however, that the known window-mounted, split air conditioning apparatus are not altogether satisfactory, especially in their installation from the interior of the room. The outdoor section tends to be relatively heavy. Unless installed properly, there is a risk that the apparatus may slide off the installer's hands and drop outside. Even if the apparatus does not fall from the window opening, the installer's hands can sometimes be pinched by the apparatus as it is being maneuvered into position. Furthermore, the apparatus is leveled and supported by point loads bearing on exterior and interior wall surfaces of the room wall through which the window opening extends. These point loads exert a great deal of pressure on the wall surfaces and typically mar and damage such wall surfaces. The exterior point loads are hard to reach from the room interior. In brief, the installation is difficult, often requires more than one skilled installer to perform the installation, and typically damages the exterior and interior wall surfaces of the room wall.

SUMMARY OF THE INVENTION

Objects of the Invention

Accordingly, it is a general object of this invention to advance the state of the art of saddle-type air conditioning apparatus.

More particularly, it is an object of the present invention to simplify the installation of such apparatus.

Still another object of the present invention is to affirmatively prevent such apparatus from falling out of a window opening, both during and after installation.

It is yet another object of the present invention to affirmatively prevent damaging the room wall through which the window opening extends.

An additional object of the present invention is to configure the apparatus with different shapes so as to avoid interference with interior structures.

FEATURES OF THE INVENTION

In keeping with the above objects and others which will become apparent hereinafter, one feature of the present invention resides, briefly stated, in an air conditioning apparatus for installation at a window opening bounded by a sill and side jambs spaced apart by a predetermined distance, the window opening extending through a room wall having exterior and interior wall surfaces. The apparatus comprises an outdoor section for housing refrigeration components, e.g., a condenser and a compressor, for dissipating heat, an indoor section for housing refrigeration components, e.g., an evaporator, for absorbing heat, and a connector section for connecting the outdoor and indoor sections, the connector section resting on the sill.

The outdoor section has a width less than said predetermined distance to enable the outdoor section to be inserted with mechanical clearance through the window opening. In accordance with one feature of this invention, the indoor section has a width greater than said predetermined distance for resisting the indoor section from passing through the window opening. The indoor section may either have a casing manufactured with this greater width, or the indoor section may be equipped with extensions movable from a retracted position within the indoor section to an extended position in which the extensions extend over a distance greater than said predetermined distance. The extensions may be moved to the extended position during installation, and then moved to the retracted position during use, or the extensions may be left in the extended position during use. The deployed extensions insure that the apparatus will not fall from the window opening.

Another feature of this invention resides in mounting a movable bearing member on the outdoor section for movement relative thereto, and in actuating an actuator for moving the bearing member towards the exterior wall surface for engagement therewith in an installed position of the apparatus. The actuator is remotely mounted on the sections away from the bearing member and is within ready access of an installer. In contrast to the use of point loads in the prior art, the bearing member is preferably a clamping plate which engages the exterior wall surface over a wide surface area.

To the same effect, a movable bearing member is mounted on the indoor section for movement relative thereto. Another actuator is remotely mounted on the sections away from the bearing member, again within ready access of the installer, for moving the bearing member towards the interior wall surface, preferably for surface area engagement therewith in the installed position, thereby resisting damage to the interior wall surface.

An additional feature of this invention is the use of a pair of handles on an upper region of the sections, both handles extending between the outdoor section and the connector section. The handles are within ready access of the installer, preferably on an upper wall, and enable the installer to lift the apparatus and insert the outdoor section exteriorly of the window opening.

Still another feature is embodied in a pair of seals mounted in the connector section for movement from a retracted position to an extended position in which the seals at least partially block air from flowing through the window opening.

It is preferable that the indoor section has a recess into which the sill extends. Also, a pair of reinforcement members is preferably mounted within the sections. Each reinforcement member has one leg within the outdoor section, another leg within the indoor section, and a connecting leg within the connector section. The reinforcement members are spaced apart and generally prevent the outdoor and indoor sections from twisting relative to each other. It is also preferable if the indoor and outdoor sections are adjustably mounted for relative movement, thereby enabling the apparatus to accommodate room walls of different thicknesses.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of one embodiment of an air conditioning apparatus according to this invention;

FIG. 2 is a perspective view of another embodiment of an air conditioning apparatus according to this invention;

FIG. 3 is a perspective view of still another embodiment of an air conditioning apparatus according to this invention;

FIG. 4 is a perspective view of the FIG. 1 embodiment installed at a window opening;

FIG. 5 is a broken-away sectional view taken on line 5—5 of FIG. 4;

FIG. 6 is a broken-away sectional view taken on line 6—6 of FIG. 4;

FIG. 7 is a broken-away sectional view taken on line 7—7 of FIG. 6;

FIG. 10 is a perspective view of yet another embodiment of an air conditioning apparatus according to this invention; and FIG. 11 is an enlarged, broken-away, sectional view taken on line 11—11 of FIG. 10.

DETAILED DESCRIPTION OF THE PREFERRED EMBODIMENTS

Figure 8:
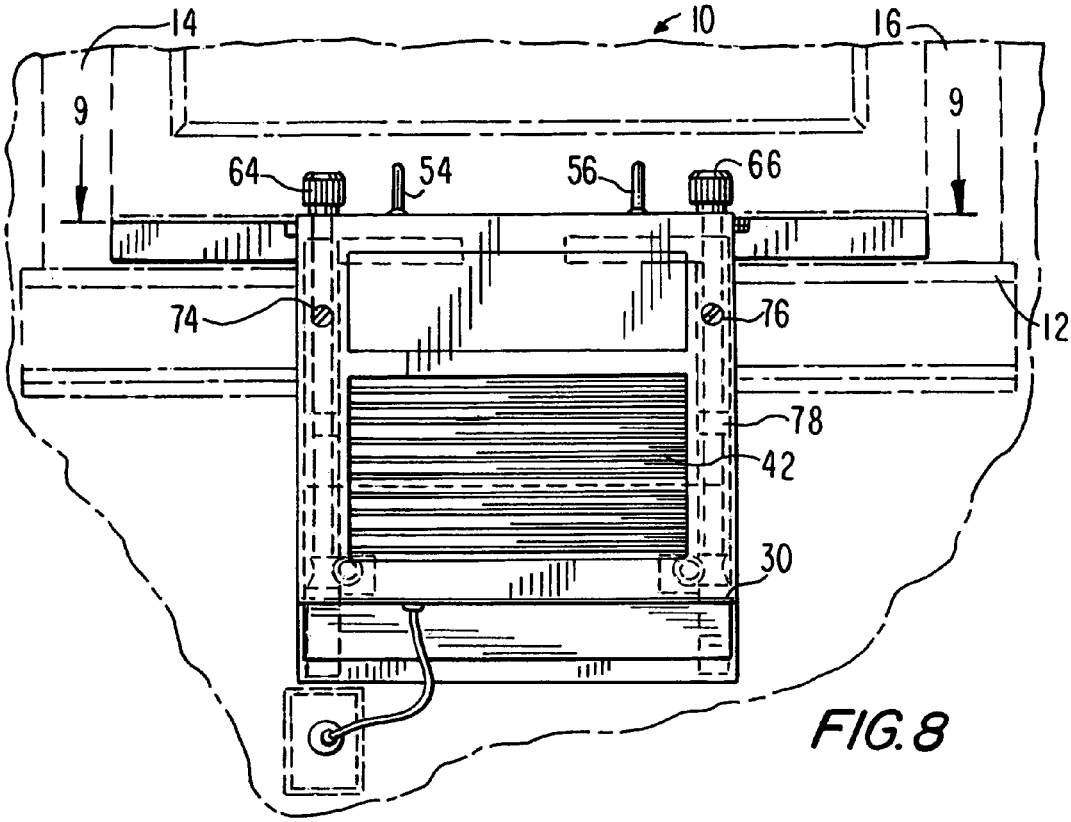
FIG. 8 is a front elevational view of the FIG. 1 embodiment installed at the window opening.

Referring now to the drawings, FIGS. 1, 2, 3 and 10 show respective embodiments of an air conditioning apparatus for installation at a window 10, as best seen in FIGS. 4–9. The window 10 is framed by a generally horizontal sill 12, a pair of vertical side jambs 14, 16 spaced horizontally apart by a predetermined distance, and an upper rail (not shown) parallel to the sill 12. The window 10 bounds an opening in which an upper sash 18 (see FIG. 5) and a lower sash 20 are each vertically slideable to open or close the window opening. The window opening extends through a room wall 22 having an exterior wall surface 24 (see FIG. 5) and an interior wall surface 26.

Referring to the FIG. 1 embodiment, the apparatus includes an outdoor section 28 or casing in which refrigeration components for dissipating heat are housed, an indoor section 30 or casing in which additional refrigeration components for absorbing heat are housed, and a connector section 32 for connecting the indoor and outdoor sections and for spacing the indoor and outdoor sections apart at opposite sides of the window in an installed position of the apparatus (FIG. 4). The connector section 32 has a low profile, that is, a small vertical height, and rests on the sill 12 in the installed position.

Figure 9:
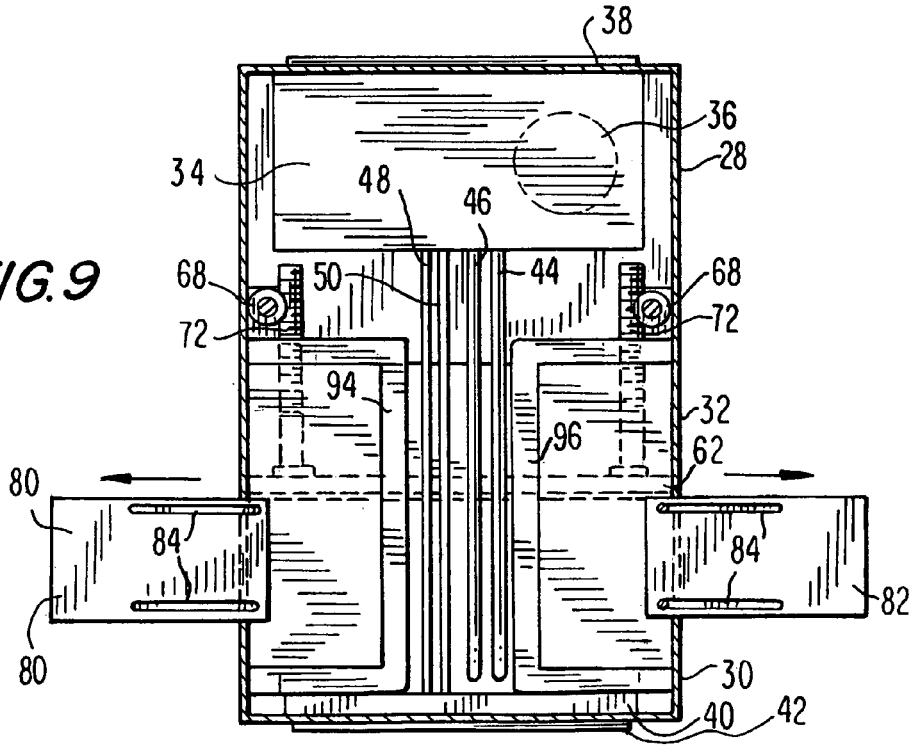
FIG. 9 is a sectional view taken on line 9—9 of FIG. 8.

The refrigeration components are entirely conventional. The heat dissipating components include a condenser 34 (see FIG. 9), a compressor 36, and a fan (not illustrated) for forcing exterior air through the grille 38 to the condenser. The heat absorbing components include an evaporator 40 and a fan (not illustrated) for drawing interior air through the grille 42 across the evaporator. The condenser 34 is connected to the evaporator 40 via a rigid or flexible refrigerant line 44 in which an expansion valve (not illustrated) is mounted, and via another rigid or flexible refrigerant line 46 in which the compressor 36 is mounted. As best seen in FIG. 9, the refrigerant lines 44, 46 are arranged to extend between the inner and outer sections through the connector section 32. Electrical wires 48, 50 are also routed through the connector section 32 between the inner and outer sections. Further details of the refrigeration system can be obtained, if desired, by reference to the above-identified patents.

Returning to the FIG. 1 embodiment, a planar upper wall 52 is common to all of the sections. At least one handle, and preferably a pair of handles 54, 56, is secured to an upper region of the sections, preferably the upper wall 52, for enabling an installer to grip and lift the apparatus and to insert the outdoor section through the window opening. For this purpose, the width of the outdoor section is less than said predetermined distance between the jambs 14, 16 for insertion of the outdoor section with mechanical clearance through the window opening. Each handle 54, 56 extends over a considerable distance over the upper wall 52 to enable the installer to readily reach the handles from the interior of the room. Each handle extends from the outdoor section to the connector section. The handles can be folded down onto the upper wall, or can be moved, or can be allowed to move, into or adjacent the outdoor seciton, when not being used.

The indoor section 30 is designed to have a width greater than said predetermined distance to prevent the indoor section from passing through the window opening. In the FIG. 1 embodiment, this greater width is achieved by a pair of extensions 58, 60 mounted on the indoor section for movement relative thereto between a retracted position and an extended position in which the extensions extend over a distance greater than said predetermined distance. The extensions are moved to the extended position during installation to prevent the apparatus from falling out of the window opening. The extensions can be left in the extended position during use as an air conditioner, but this is not preferred.

In the FIG. 2 embodiment, extensions 58, 60 are not needed, because the width of the indoor section 30A is wider than said predetermined distance. The same is true for the indoor section 30B of the FIG. 3 embodiment. The FIG. 3 embodiment is used for those applications where there are high obstructions, e.g., a radiator or furniture, underneath the window. The FIG. 2 embodiment is used for those applications where the obstructions are not as high. The FIG. 1 embodiment is used where there are no obstructions underneath the window.

Each of the embodiments has a movable bearing member, preferably a clamping plate 62, mounted on the outdoor section 28 for movement relative thereto toward the exterior wall surface 24 (see FIG. 5) for surface area contact therewith. As best seen in FIG. 5, an actuator, including a pair of knobs 64, 66 is remotely mounted on the upper wall 52 within ready access of the installer. The knobs can be located anywhere on the sections as long as the installer can reach them. Turning each knob turns a pair of respective vertical shafts 68 each having a gear 70 which meshes with a respective threaded horizontal shaft 72 to which the clamping plate 62 is attached. The broad surface area engagement insures that the relatively heavy weight of the outdoor section, which is cantilever mounted on the window sill, does not ruin the exterior wall surface 24. Each knob can be locked in place.

To the same effect, a pair of movable bearing members 75 is mounted on the indoor section 30 for movement relative thereto toward the interior wall surface 26 (see FIG. 5) for surface area contact therewith. As best seen in FIG. 8, an actuator, including a pair of screws 74, 76 is mounted on a front wall 78 of the indoor section within ready access of the installer. The screws can be located anywhere on the sections as long as the installer can reach them. Turning each screw 74, 76 moves the bearing members 75 toward the interior wall surface 26. The surface area engagement insures that the bearing members do not ruin the interior wall surface 26. Each screw can be locked in place.

Once installed, a pair of seals 80, 82 is movable from a retracted position, preferably within the connector section 32, to an extended position in which the seals at least partially block air from flowing through the window opening. As best seen in FIG. 6, each seal has a pair of linear slots 84 in which respective pins 86 are received for guiding the seals. As best seen in FIG. 7, a pair of foam strips 88 is positioned above the seals to block air flow between the lower sash 20 and the seals. Another pair of foam strips 90 is positioned below the seals to block air flow between the sill 12 and the seals.

As best seen in FIGS. 4–5, the indoor section has a recess 92 into which the sill 12 extends to as to bring the lower portion of the indoor section closer to the interior wall surface 26. A pair of reinforcement members 94, 96 is spaced apart of each other within the sections. As shown for representative reinforcement member 96 in FIG. 5, each reinforcement member has one leg 98 within the outdoor section 28, another leg 100 within the indoor section 30, and a connecting leg 102 within the connector section 32. The reinforcement members prevent the sections from twisting relative to one another, especially during installation.

Turning to FIGS. 10–11, this embodiment is identical to that of FIG. 1, except that the indoor and outdoor sections are adjustably movable relative to each other. A pair of slots 104 is formed at opposite sides of one portion of the connector section 32, and a pair of turnable locks 106 is mounted at opposite sides of another portion of the connector section 32. When the locks are turned in one direction, the two portions of the connector section are free to move linearly with a shaft of each lock being received in a corresponding slot 104. When the locks are turned in the opposite direction, the two portions are locked together preventing their relative movement. Thus, the indoor and outdoor sections can be moved toward and away from each other to a selected position, and then locked in this selected position. In this way, the apparatus can be accommodated to fit on room walls of various thicknesses. The refrigerant lines and the electrical wires are looped within the connector section to accommodate the adjustment.

Installation generally proceeds as follows. The installer grips and lifts the apparatus by the handles 54, 56 and inserts the outdoor section 28 through the window opening. The connector section 32 is rested on the sill 12. In the case of FIG. 1, the extensions 58, 60 are pulled out to the extended position. Next, the actuators 64, 66 are turned to move the clamping plate 62 toward the exterior wall surface 24. Then, the actuators 74, 76 are turned to move the bearing members 75 toward the interior wall surface 26. Foam strips 90 are laid on the sill, and the seals 80, 82 are pulled out to the extended position. Foam strips 88 are laid on top of the extended seals 80, 82, and the lower sash 20 is slid down onto the upper planar wall 52. In the case of the FIG. 10 embodiment, the distance between the indoor and outdoor sections is adjusted prior to actuating the actuators 64, 66, 74, 76.

The placement of the handles 54, 56 enables the installer to insert the outdoor section through the window opening without having to overextend his arms. The placement of the actuators 64, 66 within ready access of the installer enables remote adjustment of the clamping plate 62 without the installer having to extend very far out of the window opening. Also, the front placement of the actuators 74, 76 enables ready adjustment of the bearing members 75. The installation has been so simplified that only one installer is needed and, indeed, the installer need not be a professional installer, but could be the homeowner.

It will be understood that each of the elements described above, or two or more together, also may find a useful application in other types of constructions differing from the types described above.

While the invention has been illustrated and described as embodied in a window-mounted split air conditioning apparatus and method of installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An air conditioning apparatus for installation at a window opening bounded by a sill and side jambs spaced apart by a predetermined distance, the window opening extending through a wall having an exterior surface, the apparatus comprising:

a) an outdoor section for housing components for dissipating heat, the outdoor section having a movable bearing member and a width less than said predetermined distance for insertion with clearance through the window opening;

b) an indoor section for housing components for absorbing heat, the indoor section having a width greater than said predetermined distance for resisting the indoor section from passing through the window opening by being blocked by the side jambs;

c) a connector section for connecting the outdoor and indoor sections, the connector section resting on the sill; and d) an actuator mounted on the sections remotely of the bearing member within access to an installer for moving the bearing member toward the exterior wall surface for engagement therewith in an installed position of the apparatus.

2. The apparatus of claim 1, wherein the indoor section has extensions movable from a retracted position to an extended position in which the extensions extend over a distance greater than said predetermined distance.

3. The apparatus of claim 1, wherein the sections have an upper region, and at least one handle secured to the upper region for enabling an installer to insert the outdoor section through the window opening.

4. The apparatus of claim 3, and another handle secured to the upper region, both handles extending between the outdoor section and the connector section.

5. The apparatus of claim 1, wherein the connector section has seals movable from a retracted position to an extended position in which the seals at least partially block air from flowing through the window opening.

6. The apparatus of claim 1, wherein the indoor section has a movable bearing member, and an actuator remotely mounted on the sections within access to an installer for moving the bearing member toward an interior wall surface through which the window opening extends, the bearing member engaging the interior wall surface in contact therewith in an installed position of the apparatus.

7. The apparatus of claim 1, wherein the indoor section has a recess into which the sill extends.

8. The apparatus of claim 1, and a pair of reinforcement members spaced apart of each other within the sections, each reinforcement member having one leg extending within the outdoor section, another leg extending within the indoor section, and a connecting leg extending within the connector section.

9. The apparatus of claim 1, wherein the indoor section and the connector section lie in a common plane.

10. The apparatus of claim 1, wherein the indoor and outdoor sections are adjustably movable toward and away from each other.

11. An air conditioning apparatus for installation at a window opening bounded by a sill and extending through a room wall having exterior and interior wall surfaces, the apparatus comprising:

a) an outdoor section for housing components for dissipating heat, the outdoor section being insertable through the window opening and having a movable bearing member;

b) an indoor section for housing components for absorbing heat;

c) a connector section for connecting the outdoor and indoor sections, the connector section resting on the sill; and d) an actuator mounted on the sections remotely of the bearing member within access to an installer for moving the bearing member toward the exterior wall surface for engagement therewith in an installed position of the apparatus.

12. The apparatus of claim 11, and at least one handle secured to an upper region of the sections and extending between the outdoor section and the connector section, for enabling the installer to insert the outdoor section through the window opening.

13. The apparatus of claim 11, wherein the indoor section has another movable bearing member, and an actuator mounted on the sections remotely of the other bearing member within access of the installer for moving the other bearing member toward the interior wall surface for engagement therewith in the installed position of the apparatus.

14. The apparatus of claim 11, wherein the connector section has seals movable from a retracted position to an extended position in which the seals at least partially block air from flowing through the window opening.

15. The apparatus of claim 11, wherein the indoor section has a recess into which the sill extends.

16. The apparatus of claim 11, and a pair of reinforcement members spaced apart of each other within the sections, each reinforcement member having one leg extending within the outdoor section, another leg extending within the indoor section, and a connecting leg extending within the connector section.

17. The apparatus of claim 11, wherein the bearing member is a plate for engaging the exterior wall surface over a surface area.

18. A method of installing an air conditioning apparatus in a window opening bounded by a sill and side jambs which are spaced apart by a predetermined distance, the window opening extending through a room wall having exterior and interior wall surfaces, the method comprising the steps of:

a) housing components for dissipating heat in an outdoor section;

b) housing components for absorbing heat in an indoor section;

c) connecting the outdoor and indoor sections with a connector section;

d) securing at least one handle to an upper region of the sections;

e) mounting a bearing member on the outdoor section for movement relative thereto;

f) gripping the at least one handle and inserting the outdoor section through the window opening;

g) resting the connector section on the sill; and h) moving the bearing member toward the exterior wall surface for engagement therewith by actuating an actuator mounted remotely from the bearing member within access thereto.

19. The method of claim 18, and the steps of mounting another bearing member on the indoor section for movement relative thereto, and moving the other bearing member toward the interior wall surface for engagement therewith by actuating another actuator mounted remotely from the other bearing member within access thereto.

20. The method of claim 18, and the step of moving extensions from a retracted position to an extended position in which the extensions extend over a distance greater than said predetermined distance.

* * * * *